US005697224A

United States Patent [19]

Sumida

[11] Patent Number: 5,697,224

[45] Date of Patent: Dec. 16, 1997

[54] OPERATION CONTROL AND INDICATION DEVICE FOR AIR CONDITIONER

[75] Inventor: Hisashi Sumida, Osaka, Japan

[73] Assignee: Daikin Industries, Ltd., Osaka, Japan

[21] Appl. No.: 569,262

[22] PCT Filed: Jun. 28, 1994

[86] PCT No.: PCT/JP94/01040

§ 371 Date: Dec. 22, 1995

§ 102(e) Date: Dec. 22, 1995

[87] PCT Pub. No.: WO95/01536

PCT Pub. Date: Jan. 12, 1995

[30] Foreign Application Priority Data

Jun. 30, 1993 [JP] Japan ..... 5-161393

[51] Int. Cl.[6] ..... F25B 49/00

[52] U.S. Cl. ..... 62/125; 165/11.1; 165/209; 236/94

[58] Field of Search ..... 165/11.1, 209; 62/125, 126, 127; 236/94

[56] References Cited

U.S. PATENT DOCUMENTS

| | | | |
|---|---|---|---|
| 4,674,291 | 6/1987 | Kitauchi | 62/126 |
| 5,005,366 | 4/1991 | Murashige | 62/126 |
| 5,165,465 | 11/1992 | Kenet | 165/11.1 X |

FOREIGN PATENT DOCUMENTS

| | | | |
|---|---|---|---|
| 62-190346 | 8/1987 | Japan . | |
| 271036 | 3/1990 | Japan . | |
| 285633 | 3/1990 | Japan . | |
| 2118353 | 5/1990 | Japan . | |
| 270592 | 5/1990 | Japan . | |
| 5272789 | 10/1993 | Japan . | |
| 5296523 | 11/1993 | Japan . | |
| 6109310 | 4/1994 | Japan . | |
| 6-109319 | 4/1994 | Japan | 165/11.1 |

*Primary Examiner*—Henry A. Bennett
*Assistant Examiner*—Susanne C. Tinker
*Attorney, Agent, or Firm*—Sixbey, Friedman, Leedom & Ferguson, P.C.; Gerald J. Ferguson, Jr.

[57] ABSTRACT

An air conditioner has a plurality of indoor units (3, 3, . . . ) and a single remote controller (4). The controller (4) is provided with an anomalous unit memory section (45) for a unit number of an indoor unit (3) in operation anomaly, a button operating section (42) for inputting a check signal for checking on the location of the operation anomaly, and a forcedly fan-on section (46) for outputting a forcedly fan-on signal, at the time of input of the check signal in the case that the unit number is stored, to the indoor unit (3) having the unit number. When each of the indoor units (3, 3, . . . ) causes an operation anomaly, it outputs an anomalous condition signal to the remote controller (4) and then receives a forcedly fan-on signal from the remote controller (4) to activate a fan.

3 Claims, 5 Drawing Sheets

OPERATION CONTROL AND INDICATION DEVICE FOR AIR CONDITIONER

TECHNICAL FIELD

This invention relates to an operation control device for air conditioner and particularly relates to measures for indicating an operation anomaly or the like.

BACKGROUND ART

In general, there has been an air conditioner as disclosed in Japanese Patent Application Laying Open Gazette No.2-85633, in which a plurality of indoor units are connected to a single remote controller and the plurality of indoor units are controlled in units of groups by the remote controller.

Further, unit numbers are assigned to the indoor units respectively and control signals are transmitted and received between each of the indoor units and the remote controller according to the unit numbers.

Furthermore, when unit numbers are assigned to the indoor units respectively at the time of installation or the like of the indoor units, the unit numbers are displayed on the remote controller in order and at the same time indoor fans are activated in correspondence to the display of the unit numbers so that it is easy to examine whether the unit numbers stored in the remote controller is matched with the indoor units whose unit numbers have been assigned respectively.

Problem to be Solved

In the above-mentioned air conditioner, the indoor fans are activated for examination of the assignment of unit numbers. However, at the time when an anomaly or the like occurs in the indoor unit, no measure such as an activation of the indoor fan or the like is taken for location of the indoor unit.

More specifically, at the time when something is wrong with a motor-operated expansion valve of the indoor unit and an anomaly occurs in a drain pump, the indoor unit outputs an anomalous condition signal to the remote controller. When receiving the anomalous condition signal, the remote controller only displays the unit number of the indoor unit in which the anomaly occurs and an anomaly code.

Thus, the indoor unit in an anomalous condition gives no indication though the remote controller displays the unit number. Therefore, in order to locate the indoor unit in an anomalous condition, it is necessary to open the panels of the indoor units one by one and obtain the respective unit numbers of the indoor units. As a result, it takes much time to locate the indoor unit in an anomalous condition. This decreases in serviceability the conventional air conditioner.

The present invention has been made in view of the foregoing problem and has its object of increasing in serviceability an air conditioner by allowing a prompt location of an indoor unit in an anomalous condition or the like.

DISCLOSURE OF INVENTION

To attain the above-mentioned object, measures taken in the present invention are characterized by causing an indication in an air conditioning unit in an anomalous condition or the like when the air conditioning unit outputs an anomalous condition signal or the like.

Constitution

More specifically, as shown in FIG. 1, a measure taken in the invention of claim 1 premises an operation control device for air conditioner having: a plurality of air conditioning units (3, 3, . . . ) for executing air conditioning operations; and single control means (4) which is connected to each of the air conditioning units (3, 3, . . . ) and controls the air conditioning units (3, 3, . . . ) in units of groups.

The control means (4) is provided with: unit memory means (45) for receiving an anomalous condition signal from the air conditioning unit (3) in operation anomaly to store a unit number of the air conditioning unit (3); check signal input means (42) for inputting a check signal for checking on the location of the air conditioning unit (3) in operation anomaly; and indication signal output means (46) for outputting an indication signal, at the time of input of the check signal from the check signal input means (42) in the case that the unit memory means (45) stores the unit number of the air conditioning unit (3), to the air conditioning unit (3) having the unit number.

In addition, each of the air conditioning units (3, 3, . . . ) is provided with: anomaly determining means (32) for determining whether an operation anomaly occurs and outputting an anomalous condition signal to the control means (4) in the event of operation anomaly; and indication operating means (33) for receiving an indication signal from the control means (4) to cause an indication in the air conditioning unit (3).

Further, a measure taken in the invention of claim 2 premises, as in the invention of claim 1, an operation control device for air conditioner having a plurality of air conditioning units (3, 3, . . . ) and single control means (4).

The control means (4) is provided with: unit memory means (45) for receiving a filter sign signal from the air conditioning unit (3) whose filter is to be changed to store a unit number of the air conditioning unit (3); change signal input means (42) for inputting a change signal for indication of the air conditioning unit (3) whose filter is to be changed; and indication signal output means (46) for outputting an indication signal, at the time of input of the change signal from the change signal input means (42) in the case that the unit memory means (45) stores the unit number of the air conditioning unit (3), to the air conditioning unit (3) having the unit number.

In addition, each of the air conditioning units (3, 3, . . . ) is provided with filter sign output means (34) for outputting the filter sign signal for filter change to the control means (4); and indication operating means (33) for receiving the indication signal from the control means (4) to cause an indication in the air conditioning unit (3).

A measure taken in the invention of claim 3 is so composed that in the invention of claim 1 or 2, the indication operating means (33) of each of the air conditioning units (3, 3, . . . ) activates a fan.

Operations

In the invention of claim 1, under the above structure, air conditioning operations are controlled in a manner that control signals are transmitted and received between the plurality of air conditioning units (3, 3, . . . ) and the single control means (4). When an anomaly occurs in one air conditioning unit (3) under control of the air conditioning operation, for example, when an anomaly occurs in a motor-operated expansion valve, the anomaly determining means (32) of the air conditioning unit (3) outputs an anomalous condition signal.

In the control means (4), when the air conditioning unit (3) outputs an anomalous condition signal, the unit memory means (45) receives the anomalous condition signal and stores the unit number of the air conditioning unit (3) having transmitted the anomalous condition signal. Then, the check signal input means (42) inputs a check signal for checking on the location of the air conditioning unit (3) in operation anomaly. At this time, if the unit memory means (45) stores the above unit number of the air conditioning unit (3), the indication signal output means (46) outputs an indication signal to the air conditioning unit (3) having the above unit number. Thereafter, when the air conditioning unit (3) receives the indication signal from the control means (4), the indication operating means (33) causes an indication in the air conditioning unit (3) so that the air conditioning unit (3) in operation anomaly can be readily located.

In the invention of claim 2, when one air conditioning unit (3) outputs a filter sign signal, the unit memory means (45) of the control means (4) stores the unit number of the air conditioning unit (3), whose filter should be changed. Then, the change signal input means (42) inputs a change signal for indication of the air conditioning unit (3) whose filter should be changed. At this time, if the unit memory means (45) stores the above unit number of the air conditioning unit (3), the indication signal output means (46) outputs an indication signal to the air conditioning unit (3) having the above unit number. Thereafter, the indication operating means (33) causes an indication in the air conditioning unit (3) according to the indication signal so that the air conditioning unit (3) whose filter should be changed can be readily located.

In the invention of claim 3 according to the invention of claim 1 or 2, when each of the air conditioning units (3, 3, . . . ) receives an indication signal from the control means (4), the indication operating means (33) causes an indication in the air conditioning unit (3) in a manner to activate a fan of the air conditioning unit (3).

Effects

According to the invention of claim 1, when an air conditioning unit (3) outputs an anomalous condition signal, the air conditioning unit (3) itself gives an indication according to an indication signal from the control means (4) so that the air conditioning unit (3) in an anomalous condition can be promptly located. That is, since it is not necessary to open the panels of the air conditioning units (3) one by one and obtain unit numbers as in the conventional case, the air conditioning unit (3) in an anomalous condition can be readily identified. This makes it possible to promptly handle an anomaly thereby increasing serviceability.

According to the invention of claim 2, when an air conditioning unit (3) outputs a filter sign, the air conditioning unit (3) itself gives an indication as in the event of anomaly so that the air conditioning unit (3) whose filter should be changed can be promptly located. This enables an immediate filter change thereby increasing serviceability.

Further, according to the invention of claim 2, since the indication of an air conditioning unit (3) in the event of anomaly or the like is given in a manner of activating a fan, it is not required to provide any special indication means so that a correct indication of the air conditioning unit can be achieved while increase in cost can be prevented.

BEST MODE FOR CARRYING OUT THE INVENTION

Detailed description is made below about embodiments of the present invention with reference to the drawings.

Embodiment 1

Figure 1:
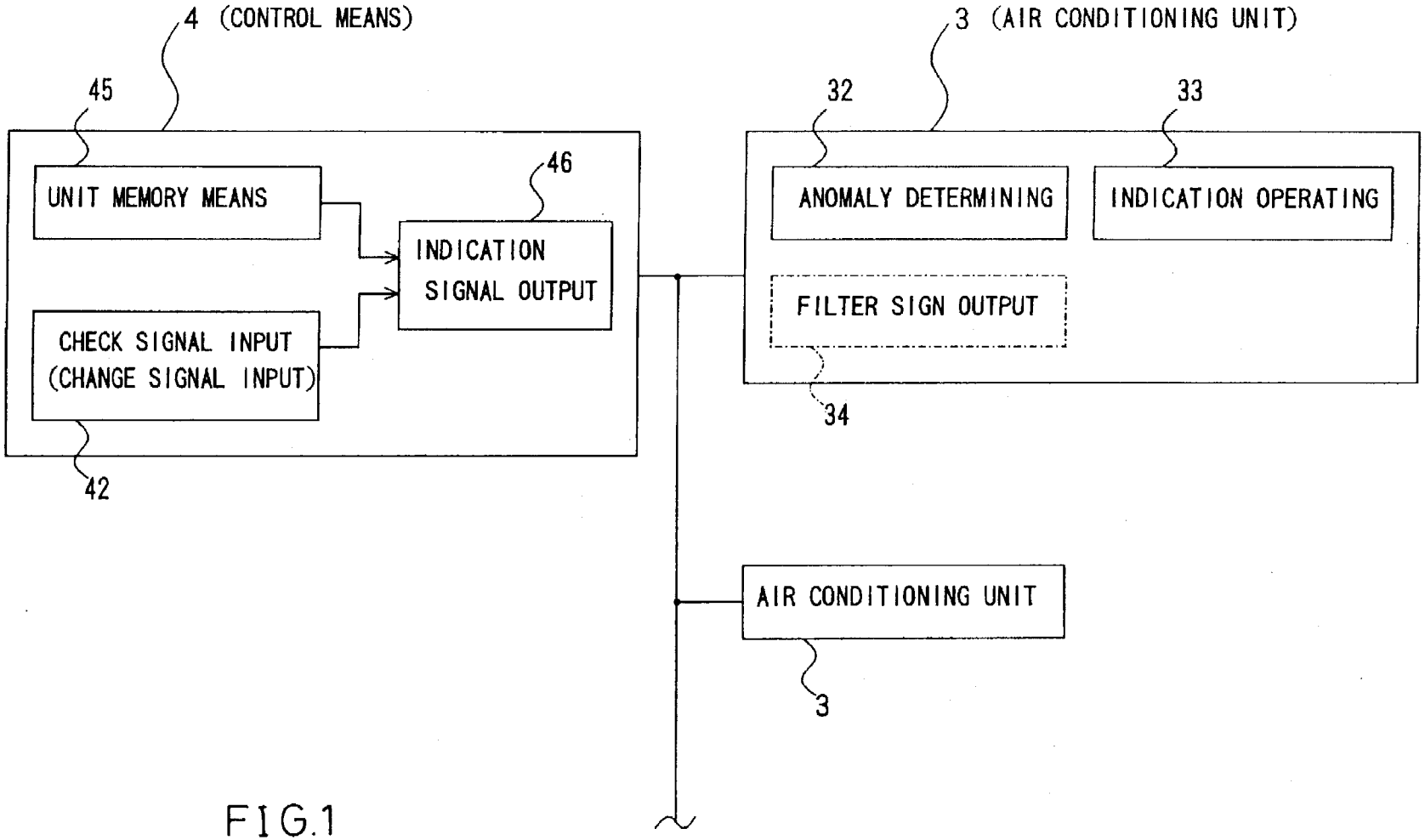
FIG. 1 is a block diagram showing a configuration of the present invention.
Figure 2:
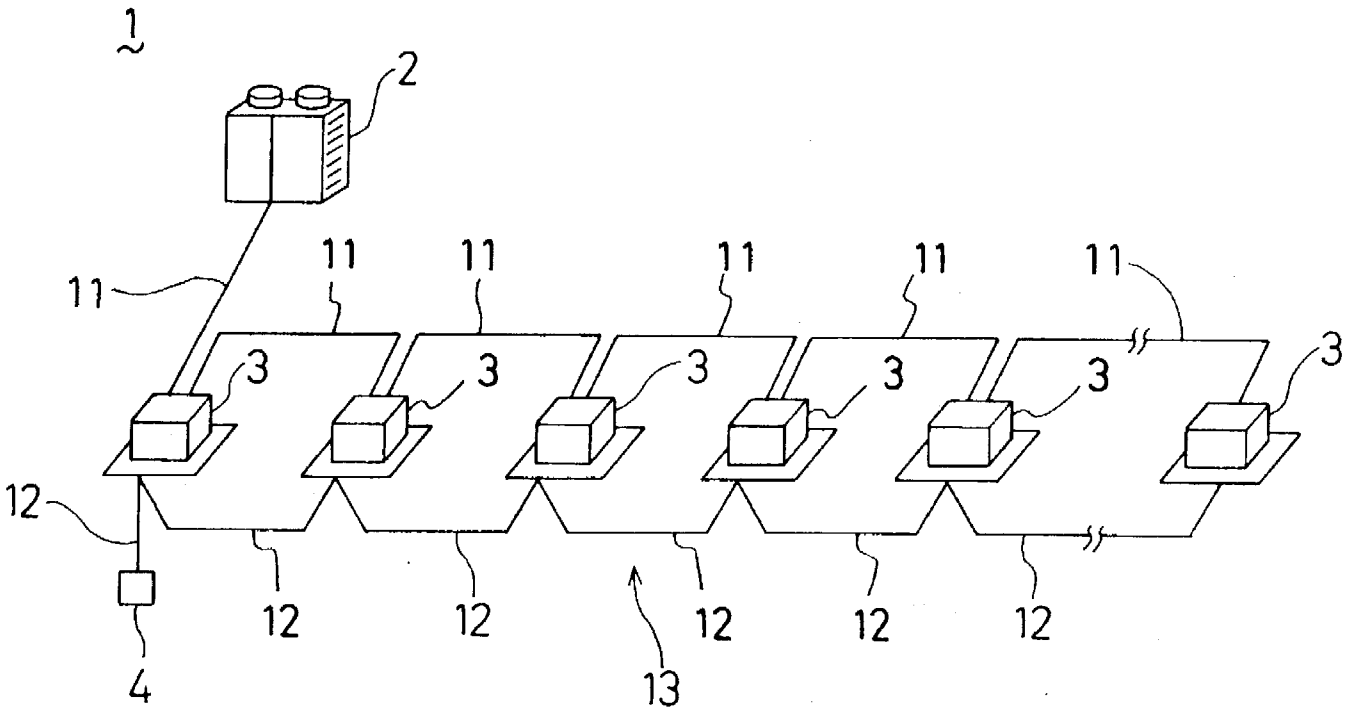
FIG. 2 is a schematic diagram showing the entire system configuration of an air conditioner.

As shown in FIG. 2, reference numeral (1) is an air conditioner which is formed in a multi-unit type that a plurality of indoor units (3, 3, . . . ) are connected to a single outdoor unit (2) through refrigerant pipes. The outdoor unit (2) has a compressor, a four-way selector valve, an outdoor heat exchanger including an outdoor fan, and a motor-operated expansion valve, which are not shown in the figure. Each of the indoor units (3, 3, . . . ) has a motor-operated expansion valve and an indoor heat exchanger including an indoor fan, which are not shown in the figure, thereby forming an air conditioning unit. The air conditioner (1) is so composed as to execute cooling and heating operations.

Further, the outdoor unit (2) is connected to each of the indoor units (3, 3, . . . ) through signal lines (11). Air conditioning operations are controlled in a manner that control signals are transmitted and received between the outdoor unit (2) and each of the indoor units (3, 3, . . . ). Each of the indoor units (3, 3, . . . ) is connected to one remote controller (4) through signal lines (12), and one group-controlled family (13) is formed of the one remote controller (4) and the plural indoor units (3, 3, . . . ) connected to the remote controller (4). In the group-controlled family (13), control signals such as operation signals are transmitted and received between the remote controller (4) and each of the indoor units (3, 3, . . . ), and these plural indoor units (3, 3, . . . ) are controlled as one group in unison by the one remote controller (4).

Figure 3:
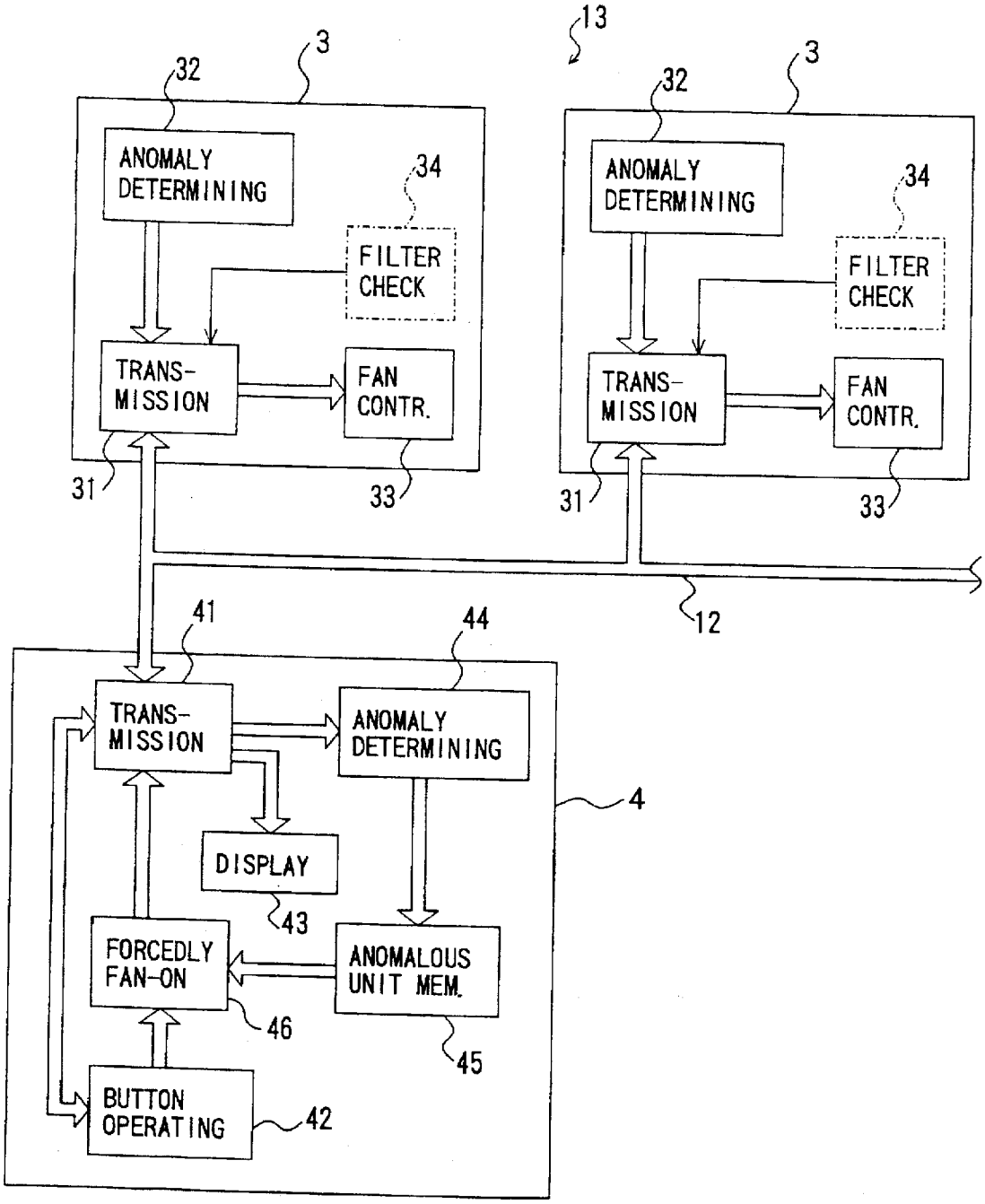
FIG. 3 is a control block diagram showing a group control system.

As shown in FIG. 3, the group-controlled family (13) is formed so that a transmission section (31) of each of the indoor units (3, 3, . . . ) is connected to a transmission section (41) of the remote controller (4) through a signal line (12). The remote controller (4) is provided with a button operating section (42) having an operation button, a temperature setting button and the like and a display (43) such as a segment display for displaying a set temperature and the like, and forms a single control means. An input signal of the button operating section (42) is transmitted to each of the indoor units (3, 3, . . . ) through the transmission section (41). The display (43) receives an output signal of each of the indoor units (3, 3, . . . ) through the transmission section (41) and displays a set temperature and the like.

Further, as a feature of the invention of claim 1, the remote controller (4) is provided with an anomaly determining section (44), an anomalous unit memory section (45) and a forcedly fan-on section (46). Each of the indoor units (3, 3, . . . ) is provided with an anomaly determining section (32) and a fan controller (33).

The anomaly determining section (44) determines whether there is an anomalous condition signal among output signals which the transmission section (31) has received from the indoor units (3, 3, . . . ). If there is an anomalous condition signal, the anomaly determining section (44) outputs an anomaly determination signal. Then, the display (43) of the remote controller (4) displays, according to the anomaly determination signal of the anomaly determining section (44), a unit number, i.e., a unit address corresponding to the indoor unit (3) in an anomalous condition, in segments or the like, and displays an anomaly cord corresponding to the anomaly type such as an anomaly of a motor-operated expansion valve, a drain pump, a sensor or the like of the indoor unit (3), in segments.

The button operating section (42) has, besides the functions as an operation button and the like, a function as a check signal input means for inputting a check signal for checking on the location of the indoor unit (3) in operation anomaly, in which the check signal is inputted therefrom by a serviceman or the like when the remote controller (4) displays a unit number of the indoor unit (3) in operation anomaly or the like.

The forcedly fan-on section (46) forms an indication signal output means for outputting an indication signal, at the time of input of a check signal from the button operating section (42) in the case that the anomalous unit memory section (45) stores the unit number of the indoor unit (3) in operation anomaly, to the indoor unit (3) having the unit number. The indication signal is outputted to the signal line (12) through the transmission section (31).

The anomaly determining section (32) of each of the indoor units (3, 3, . . . ) forms an anomaly determining means for determining whether an operation anomaly such as a motor-operated expansion valve anomaly occurs and outputting an anomalous condition signal to the remote controller (4) in the event of operation anomaly. The anomalous condition signal is outputted to the signal line (12) through the transmission section (31).

The fan controller (33) forms an indication operating means for causing an indication in the indoor unit (3) in operation anomaly when receiving an indication signal from the remote controller (4). For example, the fan controller (33) activates an indoor fan when receiving an indication signal.

Operation Controls in Embodiment 1

Next, description is made about operation controls of the air conditioner (1).

Each of the indoor units (3, 3, . . . ) and the remote controller (4) transmit and receive therebetween control signals such as an operation signal and an indoor temperature signal through the transmission sections (31, 41). Further, each indoor unit (3) and the outdoor unit (2) transmit and receive control signals therebetween. Each indoor unit (3) controls an opening of the indoor motor-operated expansion valve and the like while the outdoor unit (2) controls a capacity of the compressor and the like, thereby controlling air conditioning operations.

At the time of air conditioning operation, in the event of anomaly in an indoor motor-operated expansion valve, anomaly in a drain pump and anomaly in a sensor, the anomaly determining section (32) of the indoor unit (3) determines that an anomaly occurs in the indoor unit (3) and outputs an anomalous condition signal. The anomalous condition signal is outputted to the signal line (12) through the transmission section (31) of the indoor unit (3).

Figure 4:
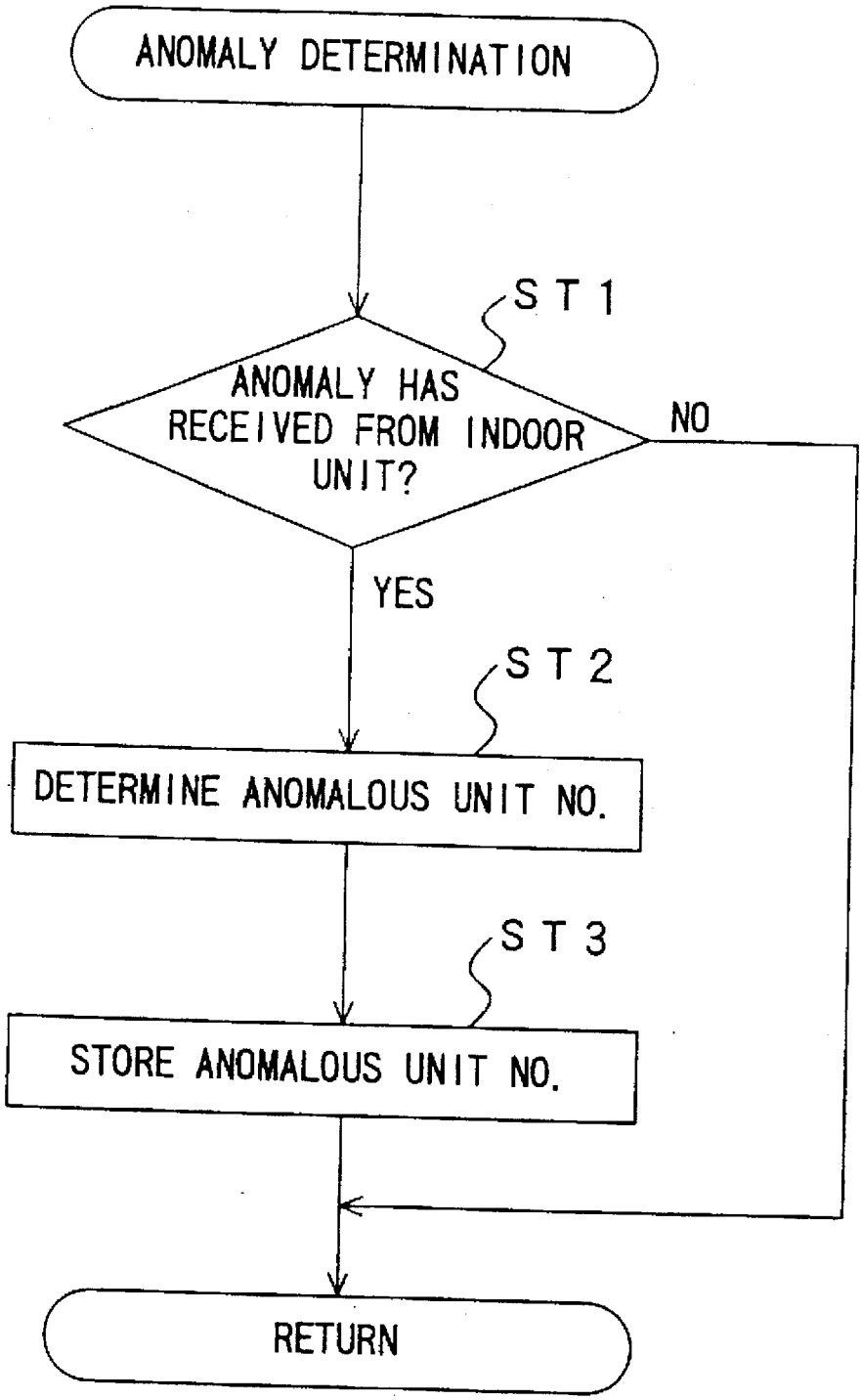
FIG. 4 is a control flow chart showing an anomaly determination processing routine.
Figure 5:
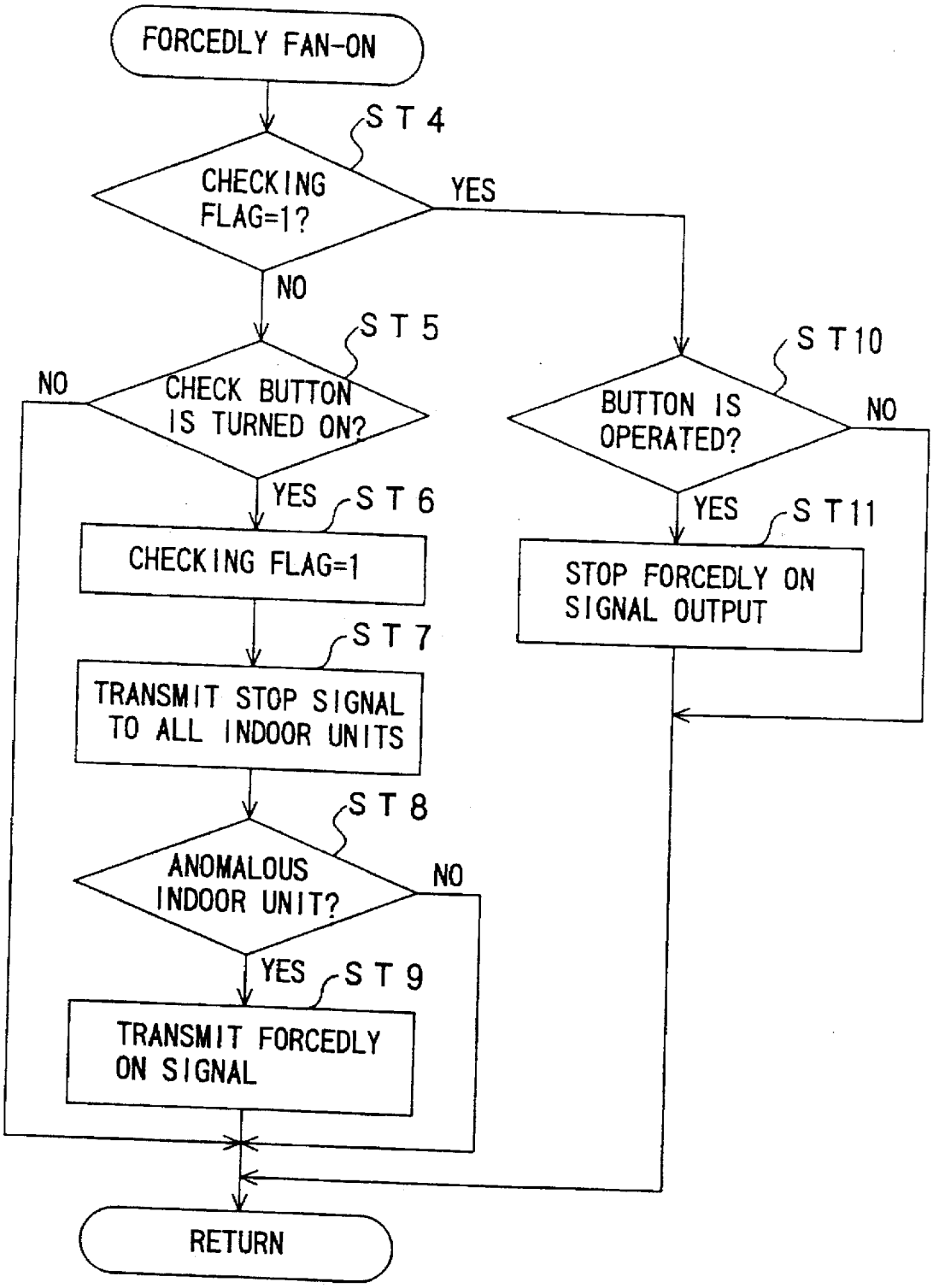
FIG. 5 is a control flow chart showing a forcedly fan-on processing routine.

Description is made next about control operations of the remote controller (4) in the event of operation anomaly of an indoor unit with reference to control flow charts of FIGS. 4 and 5.

First, an anomaly determination processing routine of FIG. 4 starts and in step ST1 determines whether the remote controller (4) has received an anomalous condition signal from an indoor unit (3). More specifically, since an output signal of an indoor unit (3) is received by the remote controller (4) through a transmission section (41), the anomaly determining section (44) determines whether the output signal of the indoor unit (3) which the transmission section (41) has received is an anomalous condition signal. When the output signal of the indoor unit (3) is a normal control signal, determination in step ST1 becomes NO so that the anomaly determination processing routine returns.

On the other hand, when the output signal of the indoor unit (3) is an anomalous condition signal, determination in step ST1 becomes YES so that the routine proceeds to step ST2, in which the unit number of the indoor unit (3) in operation anomaly is recognized, that is, the unit address of the indoor unit (3) is recognized. Thereafter, the routine proceeds to step ST3, in which the anomalous unit memory section (45) stores the unit number of the indoor unit (3) in operation anomaly. Then, the anomaly determination processing routine returns.

When the anomaly determining section (44) determines the anomaly of the indoor unit (3), the display (43) of the remote controller (4) displays the unit number and an anomaly cord corresponding to the anomaly type such as a motor-operated expansion valve anomaly.

When the anomaly determination processing routine returns, a forcedly fan-on processing routine of FIG. 5 is executed.

First, the forcedly fan-on processing routine starts and in step ST4 determines whether a checking flag is set. When the checking flag is not set, determination in step ST4 becomes NO and the routine proceeds to step ST5, where it determines whether a check button has been turned on. When an anomaly occurs in the indoor unit (3), an anomaly cord is shown on the display (43). A serviceman or the like sees the anomaly cord on the display (43) and then operates the button operating section (42) to input a check signal.

Until the button operating section (42) is operated whereby a check signal is inputted, determination in step ST5 repeats NO and the forcedly fan-on processing routine continues to return with the anomaly cord or the like remaining displayed. When a check signal is inputted, the routine proceeds from step ST5 to step ST6, where it sets a checking flag.

Thereafter, the routine proceeds from step ST6 to step ST7. In this step, since an anomaly occurs in the indoor unit (3), the remote controller (4) transmits a stop signal to all the indoor units (3, 3, . . . ) thereby deactivating all the indoor units (3, 3, . . . ).

Subsequently, the routine proceeds to step ST8, where it determines whether each indoor unit (3) is the indoor unit in operation anomaly. In other words, a search for the indoor unit (3) in operation anomaly is conducted in the order of unit numbers. Until the unit number stored in the anomalous unit memory section (45) is found, the forcedly fan-on processing routine continues to return. When the unit number stored in the anomalous unit memory section (45) is found, determination in step ST8 becomes YES and the routine proceeds to step ST9, in which the forcedly fan-on section (46) outputs a forcedly on signal as an indication signal. Then, the forcedly fan-on proceeding routine returns.

The forcedly on signal is transmitted to the indoor unit (3) through the transmission section (31). Further, the forcedly on signal is received by the indoor unit (3) and is transmitted to the fan controller (33) through the transmission section (31), so that the indoor unit (3) in operation anomaly activates an indoor fan according to a control signal of the fan controller (33). The activation of the fan enables the serviceman to locate the indoor unit (3) in operation anomaly.

On the other hand, when the checking flag is set in step ST4, determination becomes YES so that the routine proceeds to step ST10. More specifically, when a forcedly on signal is outputted in step ST9, the routine proceeds to step ST10 through step ST4. In step ST10, whether there has been an operation of the button operating section (42) is determined. Until the button operating section (42) is operated, determination in step ST10 is NO and the forcedly fan-on processing routine continues to return. When the button operating section (42) is operated, determination in step ST10 becomes YES so that the routine proceeds to step ST11, in which the output of the forcedly on signal is stopped. Then, the forcedly fan-on processing routine returns.

In other words, when any one of buttons is turned on in the button operating section (42) after a forcedly on signal is outputted in step ST9, the output of the forcedly on signal is stopped so that the fan of the indoor unit (3) is deactivated.

Effects of Embodiment 1

As mentioned above, according to the present embodiment, when the indoor unit (3) outputs an anomalous condition signal, the indoor unit (3) activates a fan according to a forcedly on signal from the remote controller (4). This allows a prompt location of the indoor unit (3) in operation anomaly. That is, it is not necessary to open the panels of the indoor units (3) one by one to obtain the unit numbers as in the conventional manner, so that the indoor unit (3) in operation anomaly can be readily located. This makes it possible to promptly handle an anomaly thereby increasing serviceability.

Further, since the anomaly indication is executed by activating a fan, no special indication means is needed so that a correct indication can be achieved while increase in cost can be prevented.

Embodiment 2

Another embodiment of the present invention, according to claim 2, is so composed as to activate an indoor fan in response to a filter sign as shown in FIG. 3.

More specifically, each of the indoor units (3, 3, . . . ) is provided with a filter check section (34). The filter check section (34) forms a filter sign output means which outputs a filter sign signal for filter change to the remote controller (4) based on a period of operation or the like. The filter sign signal is transmitted to the remote controller (4) through the transmission section (31).

The anomaly determining section (44) of the remote controller (4) is so composed as to determine that a filter sign signal of the indoor unit (3) is one of anomalous condition signals and output a filter-change determination signal. The anomalous unit memory section (45) is so composed as to store a unit number of the indoor unit (3) whose filter should be changed according to the filter-change determination signal. The remote controller (4) receives a filter sign signal and then displays the unit number on the display (43). The button operating section (42) forms a change signal input means for inputting a change signal for indication of the indoor unit (3) whose filter should be changed.

The fan controller (33) of each of the indoor units (3, 3, . . . ) is so composed as to activate an indoor fan for indication of the indoor unit (3) when receiving an indication signal from the remote controller (4).

Filter Sign Control Operations in Embodiment 2

Next, description is made about control operations on a filter sign. This control operations are substantially equal to the control operations in the event of operation anomaly shown in FIGS. 4 and 5. When the indoor unit (3) outputs a filter sign signal, the remote controller (4) determines whether to receive the filter sign signal. When the signal has been received, the unit number of the indoor unit (3) which has transmitted the filter sign signal is stored.

Subsequently, it is determined whether the button operating section (42) has been operated. More specifically, when receiving the filter sign signal from the indoor unit (3), the remote controller (4) displays the unit number of the indoor unit (3) whose filter should be changed on the display (43). A serviceman or the like sees the indication and then operates the button operating section (42) thereby inputting a change signal. The forcedly fan-on section (46) outputs a forcedly on signal according to t he change signal, so that the fan controller (33) of the indoor unit (3) whose filter should be changed activates an indoor fan. The activation of the fan enables the serviceman or the like to locate the indoor unit (3) whose filter should be changed.

Effects of Embodiment 2

As mentioned above, according to the present embodiment, when the indoor unit (3) outputs a filter sign, the indoor unit (3) itself gives an indication by activating a fan thereof as in the event of operation anomaly in Embodiment 1, so that the indoor unit (3) whose filter should be changed can be promptly located. This allows a prompt filter change thereby increasing serviceability.

Other Modifications

In the present embodiments, an indication of an anomaly or the like is executed by activating an indoor fan of an indoor unit (3). Alternately, in the inventions of claim 1 and 2, an indication alarm may be provided as indication executing means for anomaly indication or the like in each indoor unit (3), or other indoor actuators may be activated for anomaly indication or the like.

The control means is not limited to the remote controller (4) and may be a central controller or the like.

Industrial Applicability

As described so far, according to an operation control device for air conditioner of the present invention, an indoor unit itself in which an operation anomaly occurs or whose filter should be changed gives an indication. Accordingly, the present invention is adaptable to air conditioners in which a plurality of indoor units are provided.

I claim:

1. An operation control device for air conditioner having:

a plurality of air conditioning units (3, 3, . . . ) for executing air conditioning operations; and single control means (4) which is connected to each of the air conditioning units (3, 3, . . . ) and controls the air conditioning units (3, 3, . . . ), the control means (4) comprising:

unit memory means (45) for receiving an anomalous condition signal from the air conditioning unit (3) in operation anomaly to store a unit number of the air conditioning unit (3);

check signal input means (42) for inputting a check signal for checking on the location of the air conditioning unit (3) in operation anomaly; and indication signal output means (46) for outputting an indication signal, at the time of input of the check signal from the check signal input means (42) in the case that the unit memory means (45) stores the unit number of the air conditioning unit (3), to the air conditioning unit (3) having the unit number, each of the air conditioning units (3, 3, . . . ) comprising:

anomaly determining means (32) for determining whether an operation anomaly occurs and outputting an anomalous condition signal to the control means (4) in the event of operation anomaly; and indication operating means (33) for receiving an indication signal from the control means (4) to cause an indication in the air conditioning unit (3).

2. An operation control device for air conditioner having:

a plurality of air conditioning units (3, 3, . . . ) for executing air conditioning operations; and single control means (4) which is connected to each of the air conditioning units (3, 3, . . . ) and controls the air conditioning units (3, 3, . . . ), the control means (4) comprising:

unit memory means (45) for receiving a filter sign signal from the air conditioning unit (3) whose filter is to be changed to store an unit number of the air conditioning unit (3);

change signal input means (42) for inputting a change signal for indication of the air conditioning unit (3) whose filter is to be changed; and indication signal output means (46) for outputting an indication signal, at the time of input of the change signal from the change signal input means (42) in the case that the unit memory means (45) stores the unit number of the air conditioning unit (3), to the air conditioning unit (3) having the unit number, each of the air conditioning units (3, 3, . . . ) comprising:

filter sign output means (34) for outputting a filter sign signal for filter change to the control means (4); and indication operating means (33) for receiving the indication signal from the control means (4) to cause an indication in the air conditioning unit (3).

3. An operation control device for air conditioner according to claim 1 or 2, wherein the indication operating means (33) of each of the air conditioning units (3, 3, . . . ) activates a fan.

* * * * *